US007740148B2

(12) United States Patent
Rajagopalan et al.

(10) Patent No.: US 7,740,148 B2
(45) **Date of Patent: *Jun. 22, 2010**

(54) CONTAINER BOTTOM

(75) Inventors: Mahesh Rajagopalan, Wildwood, MO (US); Charles E. Brossia, Chesterfield, MO (US); Carl Szwargulski, Ballwin, MO (US); Michael Jansma, Eureka, MO (US); John Cooley, Columbus, OH (US)

(73) Assignee: Metal Container Corporation, St. Louis, MO (US)

( * ) Notice: Subject to any disclaimer, the term of this patent is extended or adjusted under 35 U.S.C. 154(b) by 29 days.

This patent is subject to a terminal disclaimer.

(21) Appl. No.: 12/173,441

(22) Filed: Jul. 15, 2008

(65) Prior Publication Data

US 2008/0264954 A1 Oct. 30, 2008

Related U.S. Application Data

(63) Continuation of application No. 10/983,841, filed on Nov. 8, 2004, now Pat. No. 7,398,894.

(60) Provisional application No. 60/524,699, filed on Nov. 24, 2003.

(51) Int. Cl.
*B65D 6/28* (2006.01)
*B65D 8/04* (2006.01)

(52) U.S. Cl. ..... 220/608; 220/609; 220/906

(58) Field of Classification Search ..... 220/606, 220/608, 609, 906; 215/373
See application file for complete search history.

(56) References Cited

U.S. PATENT DOCUMENTS 1,679,676 A 8/1928 Miele
2,936,020 A 5/1960 Thornburg et al.
3,559,258 A 2/1971 Gardner
3,693,828 A 9/1972 Kneusel et al.
3,728,059 A 4/1973 de Putter
3,942,673 A 3/1976 Lyu et al.
4,341,321 A 7/1982 Gombas
4,515,284 A 5/1985 Lee, Jr. et al.
4,685,582 A 8/1987 Pulciani et al.
4,768,672 A 9/1988 Pulciani et al.
4,834,256 A 5/1989 McMillin
4,885,924 A 12/1989 Claydon et al.
4,919,294 A 4/1990 Kawamoto et al.

(Continued)

*Primary Examiner*—Anthony Stashick
*Assistant Examiner*—Harry A Grosso
(74) *Attorney, Agent, or Firm*—Paul V. Storm, Esq.; Mark D. Perdue, Esq.; Storm LLP

(57) ABSTRACT

The invention includes a novel profile for a container bottom. The bottom structure includes a domed central panel attached at its outside edge to a downwardly projecting substantially cylindrical inner leg portion. The inner leg portion is attached to a generally semi-circular nose portion. The outside of the nose portion is attached to an upwardly and outwardly inclined outer leg portion. The outer leg portion is attached to an outwardly inclined peripheral portion. The peripheral portion is attached to the lower end of the generally cylindrical sidewall portion. The improvement primarily involves the larger stand diameter, and altered dome circle radius and dome depth, which produces a container bottom profile yielding more consistent results in drop tests to determine resistance to bulging and reversals (single can and consumer package flat and angled drop tests) than prior art can bottoms.

9 Claims, 2 Drawing Sheets

U.S. PATENT DOCUMENTS 5,105,973 A 4/1992 Jentzsch et al.
5,222,385 A 6/1993 Halasz et al.
5,325,696 A 7/1994 Jentzsch et al.
5,349,837 A 9/1994 Halasz et al.
5,355,709 A 10/1994 Bauder et al.
5,524,468 A 6/1996 Jentzsch et al.
5,593,063 A 1/1997 Claydon et al.
5,730,314 A 3/1998 Wiemann et al.
6,131,761 A 10/2000 Cheng et al.
7,398,894 B2 * 7/2008 Rajagopalan et al. ..... 220/608

* cited by examiner

CONTAINER BOTTOM

CLAIM OF PRIORITY

This application is a continuation of U.S. Pat. No. 7,398,894, entitled "Container Bottom," and which claims the benefit of U.S. Provisional Patent Application No. 60/524,699, entitled "Container Bottom and Method of Manufacture," filed on behalf of Mahesh Rajagopalan, Charles E. Brossia and Carl Szwargulski on Nov. 24, 2003. Each application is hereby incorporated by reference for all purposes.

TECHNICAL FIELD

The invention relates generally to the design and manufacture of drawn and ironed beverage containers (cans), and in particular to an improved design for the can bottom structure and the method of manufacturing the improved can design.

BACKGROUND

Two piece aluminum containers are used extensively for packaging beverages such as beer, carbonated soft drinks and other beverages such as tea. The two piece containers (cans) are comprised of a can body, which is typically made from lightweight materials, such as aluminum or aluminum alloys, and a can lid, which forms the top of the container. After the beverage has been introduced into the internal cavity formed by the can body, the can lid is placed on the open end at the top of the can body, and the can body and can lid are joined together to form a sealed container for the beverage contained therein.

The can body is manufactured by a method called drawing and ironing. The process begins with a plurality of generally circular pieces being punched from a flat sheet of material, which is typically packaged in large rolls. Each blank is then drawn to produce relatively shallow cup-shaped pieces. Next, in a sequence of ironing operations, the cup is placed over a punch and forced through a set of dies to stretch and thin the side walls until the cup is of approximately the desired can height. After the side-walls have been drawn, the bottom portion of the can is still flat, unworked and of about the same thickness as the original sheet metal.

The bottom profile of a can body is typically formed as the last step, in a pressing process that draws material to the required shape and dimensions. The most common bottom profile for a can is a dome bottom, wherein a large portion of the can bottom is formed into a spherical inwardly concave dome, with a convex annular portion, or foot formed around the outer diameter of the can bottom on which the can stands when it is upright on a horizontal surface. This configuration has been found to resist deformation of the can bottom under internal pressure, provides sufficient strength to hold the formed can and its contents in an upright position, and resist ruptures and bulging. The can bottom dome is formed when a punch, sometimes referred to as punch nose tooling, which is positioned in the interior of the can body is forced against an end-forming die, sometimes called a dome plug, located on the outside of the can body, to form the generally upwardly extending dome configuration that becomes the bottom of the can. After the can body has been formed, the open top of the can is trimmed to ensure a smooth continuous flat top edge to ensure a continuous seal with the can lid.

The need for a strong can bottom has required substantial thickness be retained in the bottom to achieve desired performance. If the can bottom is not sufficiently strong, the central dome area may reverse shape, becoming convex if the filled can is subject to high pressure. The resistance of a can bottom to reversing is one criteria which is used to measure the strength of a particular can bottom profile. This pressure is referred to as the "dome reversal pressure" or DRP. Design changes that increase the dome reversal pressure make the can more robust in higher pressure situations, such as in pasteurizing equipment.

Another criteria for measuring the strength of a particular bottom profile is drop resistance, which is the capability of a container bottom to resist a downward bulge when dropped from a height.

The pressure at which the can dome reverses or can bottom otherwise bulges or fails in response to dropping may be dependent upon can bottom design, gauge thickness, and the internal pressure of the can, which in turn is directly related to a variety of factors, such as the formula of the beverage in the can, carbonation of the beverage in the can, and ambient temperature conditions.

In some circumstances, the standard cans previously used in the industry, such as those disclosed in U.S. Pat. No. 6,182,852, may fail, especially in areas with temperature or pressure extremes, or when beverages that exert greater internal pressure are placed in the cans. Thus, there remains a need for improved container bottom profiles that show an increased resistance to failures. Further, there exists a need for improved tests so that failures in the consumer environment can be more accurately predicted, anticipated, and therefore prevented by designing cans that meet market needs better.

SUMMARY

In accordance with a preferred embodiment of the present invention, many of the disadvantages, shortcomings, and problems associated with previous container designs have been substantially reduced or eliminated.

To facilitate understanding of the disclosure herein presented, clarification of certain of the terms used herein is provided. The terms "container" and "can" are used interchangeably. "Container stand plane" means an imaginary horizontal plane perpendicular to a longitudinal central axis of the container, and upon which the container bottom would rest when placed in an upright position on a horizontal surface. As related especially to elements of the container, "downwardly" means a direction towards the container stand plane, and "upwardly" means a direction away from the container stand plane, unless otherwise noted. Likewise, "outwardly" means a direction away from the longitudinal central axis of the container, and "inwardly" means a direction towards the longitudinal central axis of the container, unless otherwise noted.

One advantage of a preferred embodiment of the present invention is that it increases the drop resistance of the can to downward bulges, which are considered unacceptable failures of the cans. Other advantages of the present disclosure will become apparent from the following descriptions, taken in connection with the accompanying drawings, wherein, by way of illustration and example, embodiments of the present invention are disclosed.

While there are a variety of cans having domed central panels, the embodiment of the present invention is an improvement over the cans of the prior art for one or more reasons, as explained below.

For example, U.S. Pat. No. 3,693,828 to Kneusel et al. discloses a unibody can having a domed central panel. However, the can of Kneusel only provides for a single section in the outer leg between the nose and can side wall. Similarly, U.S. Pat. No. 4,685,582 to Pulciani discloses a unibody can bottom having a domed central panel and a single section in the outer leg separated from the can side wall by a single, inwardly directed transitional radii. Similarly, U.S. Pat. No. 4,919,294 to Kawamoto et al. discloses a unibody can having a domed central panel that has two arrangements. One arrangement, like the arrangement in the Kneusel patent, has only a single straight, outwardly angled outer leg; the other arrangement has an outer leg that is has a single section that is inwardly convex in shape. In contrast, the can in accordance with a preferred embodiment of the present invention provides for two leg portions separated by a transitional radii, which provides for greater strength, stability and versatility over the prior art can.

In a preferred embodiment of the present invention, a container is disclosed, having a sidewall portion, an open top to which a can lid is sealed after the can has been filled, and a bottom structure of a unique configuration. The bottom structure has a domed central panel. The outer edge of the domed central panel is attached to the upper edge of a substantially cylindrical vertical inner leg portion by means of a transitional radii. The lower edge of the inner leg portion is attached to the inside edge of a generally semi-circular nose portion by means of an inner bottom nose radius. The outside edge of the nose portion is attached to the lower edge of an upwardly and outwardly inclined outer leg portion by means of an outer bottom nose radius. The upper edge of the outer leg portion is attached to the lower edge of an outwardly inclined peripheral portion by means of an inwardly directed transitional radii. The upper edge of the peripheral portion is attached to the lower end of the generally cylindrical vertical sidewall portion that extends axially about the centerline of the container by means of an outwardly directed transitional radii.

The can bottom in accordance with a preferred embodiment of the present invention comprises a domed central panel, a substantially cylindrical inner leg portion extending generally downwardly from the central panel and inwardly from the central axis, a generally semi-circular nose portion extending from adjacent to the inner leg portion, an outer leg portion extending generally upwardly and outwardly from the outside of the nose portion and outwardly from the central axis, and an inclined peripheral portion extending generally upwardly and outwardly from the outside of the outer leg portion to connect to the lower end of the sidewall.

Additionally, new tests that were developed to more accurately predict the performance of can bottoms in use in actual consumer environments are disclosed herein.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
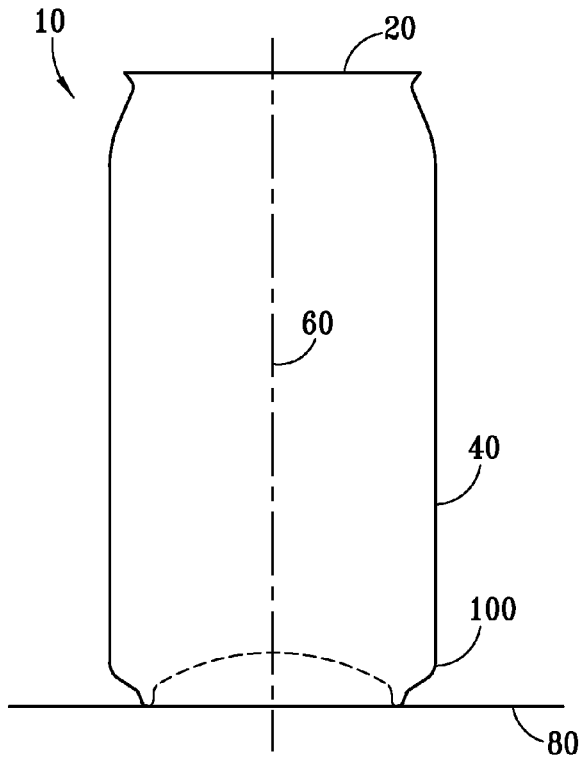
FIG. 1 is a cross-sectional side view of a standard beverage can in which the preferred embodiment may be used.

In the discussion of the FIGURES, the same reference numerals will be used throughout to refer to the same or similar components. In the interest of conciseness, various other components known to the art, such as can drawing and ironing equipment, punch nose tooling, and the like, have not been shown or discussed.

In the following discussion, numerous specific details are set forth to provide a thorough understanding of the present invention. However, various modifications to the disclosed embodiments will be readily apparent to those skilled in the art, and the general principles defined herein may be applied to other embodiments and applications without departing from the spirit and scope of the present disclosure. Thus, deviations from the described invention can be made and still achieve the desired outcome in accordance with a preferred embodiment of the present invention. Therefore, for measurements made herein, assume a tolerance of ±0.015 inches, and for angles, assume a tolerance of ±20, unless otherwise specified.

FIG. 1 is a side cross-sectional side view of a typical container 10. Container 10 has an open-ended mouth portion 20 at its uppermost end. Mouth portion 20 is integrally attached to generally circumferential or cylindrical sidewall portion or body 40. Sidewall portion 40 is attached at its lowermost end to bottom structure 100, thus forming an open-ended vessel. Container 10 has a longitudinal central axis 60, perpendicular to a container stand plane 80. The design of bottom structure 100 is further detailed in FIG. 2.

Figure 2:
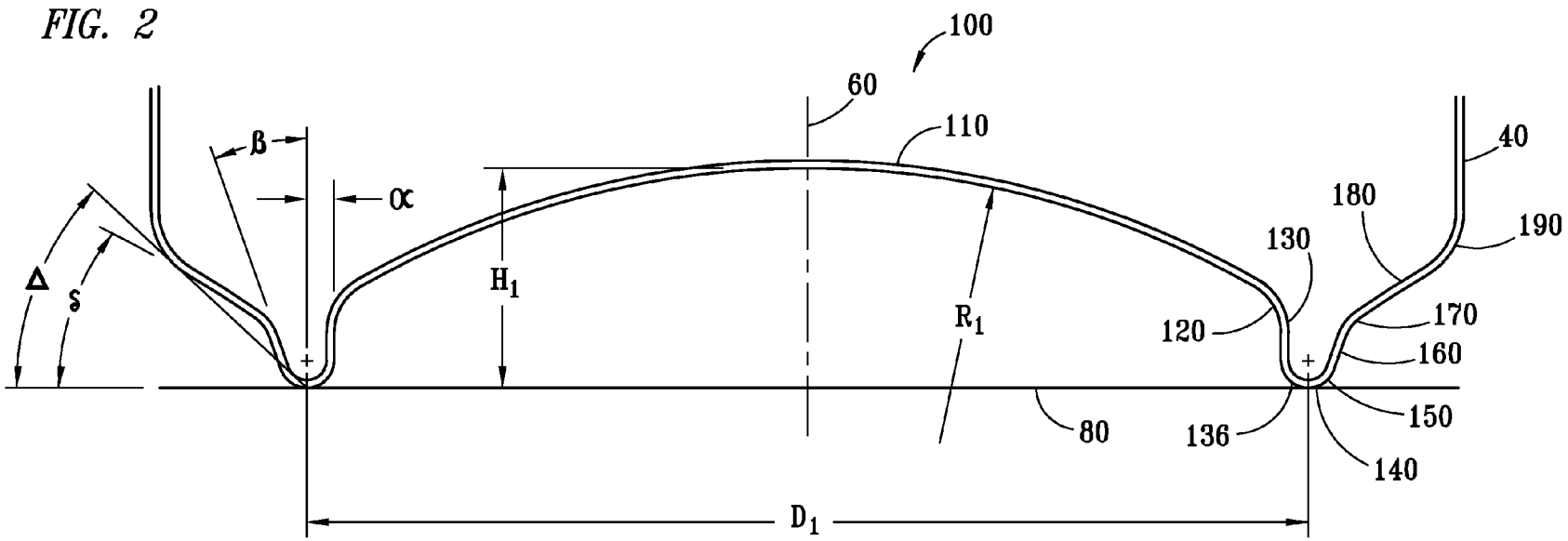
FIG. 2 is an enlarged cross-sectional side view of the bottom of the container, showing the details of a preferred embodiment of the present invention.

FIG. 2 is an enlarged cross-sectional side view of bottom structure 100 of container in FIG. 1. As can be seen in this view, a domed central panel 110 forms the center of bottom structure 100, intersecting the central axis 60. The domed central panel 110 is generally concave and has a radius of curvature, R1, that is approximately 1.5 inches at a point that is approximately 0.445 inches from central axis 60. In the design for container 10 disclosed herein, the top or apex of the domed central panel 110 has a height, H1, before spring back, if any, that is preferably from about 0.42 to about 0.47 inches above the container stand plane 80, more preferably about 0.435 to 0.460 inches, and most preferably about 0.443 inches. Prior art cans have a domed central panel that has a height above the stand plane of about 0.425 inches.

Extending from the outer edge of the central panel 110 is the upper edge of an inner leg portion or inner leg member 130 by means of a transitional inner radii or third transitional member 120, which is generally concave. The preferred value of transitional inner radius 120 is about 0.0500 inches. The inner leg portion 130 extends generally axially downwardly from the central panel 110, and is inclined inwardly toward longitudinal central axis 60 of container 10 at angle $\alpha$. The preferred angle $\alpha$ can be less than about 4° relative to the central axis 60 and can, most preferably, be about 2°24', ±1° relative to the central axis 60. Thus, the inner leg member 130 can be described as substantially or generally cylindrical or generally frustoconical in shape.

Extending from the lower edge of inner leg portion 130 is a generally semi-circular nose portion or nose member 140 by means of an inner bottom nose radius 136. The preferred value of inner bottom nose radius 136 is about 0.0600 inches. Prior art cans have a inner bottom nose radius of about 0.025 inches. The lowest point of the nose 140 is tangential to container stand plane 80. Nose portion 140 forms a "ring" upon which container 10 may rest upright on the container stand plane 80, or other horizontal surfaces; thus, this "ring" is generally coplanar with the stand plane 80. The nose diameter, or rim stand diameter, D1, of a can in accordance with a preferred embodiment of the present invention (the distance from the center of the nose portion 140 on one side of the can to the center of the nose portion directly across the can) is preferably 1.850 inches, ±0.010 inches. This nose radius, which is larger than prior art cans, provides better stability, such that when the cans are being moved along a conveyor and conveyor transfer plates, there are fewer tipped-over cans that can cause conveyor jams, especially when the cans are empty. If used with cans of a different size, the preferred ratio between the rim stand diameter to the outside diameter of the can as a whole should be approximately 0.71 to achieve the balance. Fewer tipped-over cans mean increased production efficiency. However, the nose radius is still of a size that the beverage container can be stacked on top of another beverage container and rest on the lid of the lower container.

Extending from the outside edge of nose portion 140 is the lower edge of an upwardly and outwardly inclined frustoconical outer leg portion or outer leg member 160 by means of an inwardly directed outer bottom nose radius 150. The preferred value of outer bottom nose radius 150 is about 0.0747 inches. The outer leg portion 160 extends generally axially upward, and is inclined outward at angle β. The preferred angle β can be from about 27° to about 32° relative to the central axis 60 and can, most preferably, be about 29°37' relative to the central axis 60. Extending from the upper edge of the outer leg portion 160 is the lower edge of an outwardly and upwardly inclined frustoconical peripheral portion or peripheral member 180 by means of an inwardly directed transitional outer leg radius or second transitional member 170, which is generally concave. The preferred value of transitional outer leg radius 170 is about 0.0800 inches. The inclined peripheral portion 180 extends generally axially upward from the stand plane 80 at angle δ. The preferred angle δ can be from about 27° to about 32° relative to the stand plane 80, and can, most preferably, be about 29°20' relative to the stand plane 80. Alternatively, angle δ can be from about 58° to about 63° relative to the central axis 60.

Extending from the upper edge of the inclined peripheral portion 180 is the lower end of the generally cylindrical sidewall portion or body 40, which extends axially about the centerline of the container by means of an outwardly directed transitional radii or first transitional member 190, which is generally convex. The preferred value of transitional outer radius 190 is about 0.1610 inches. A line drawn between the bottom of the nose portion 140 and the bottom of the outwardly directed transitional radii 190 or at the apex of the first transitional member 190 forms an angle Δ upward from the stand plane 80. The preferred value for angle Δ can be from about 38° to about 43° relative to the stand plane 80 and can, most preferably, be about 40°31' relative to the stand plane.

While various can bottom shapes and thicknesses can be designed, the products must be able to perform in use; i.e. they must hold beverages without leaking, reversing, bulging, or experiencing other failures, while maintaining the food or beverage within in a consumable state that is satisfactory to the ultimate consumer. The cans must also be able to withstand the pressure applied to the inside of the can by the carbonated beverage contained therein. Additionally, the can design must function to enable stacking of cans of similar construction in more than one layer, while maintaining a stability of the stacked structure. Therefore, the can bottom must sit stably on or nest in, a can lid attached to the top of a can below it in the stack. This can be achieved by having two or more points of contact between the can bottom and adjacent can lid and/or can neck.

The performance of a can will vary, even in a specific type of can, depending on a variety of factors, such as the formula of the beverage in the can, carbonation of the beverage in the can, and ambient temperature conditions. Two similar filled cans in different environments could bulge or reverse at different pressures. For example, as the temperature of the beverage in a can increases, the beverage exerts more pressure against the inside of the can than a similar can of beverage at a lower temperature. Additionally, carbonated beverages in a can apply more outward pressure against the can than non- or low-carbonated beverages. In both these situations, the drop and reversal resistance of the can bottom is related in part to the internal pressure of the can. Similarly, the outside, or atmospheric pressure, can also impact the pressure at which the dome reverses or can bulges.

Testing is performed on cans to ensure they meet various requirements for use. In addition to meeting certain specified standards, it is desirable to anticipate how cans will perform in the consumer environment (i.e., stores, homes, etc.). As previously stated, it should be appreciated that test results can vary based on location and other atmospheric factors.

One standard test for can bottoms is the "buckle test" which determines the pressure, in pounds per square inch (psi), applied to the inside bottom of a can before the can bottom buckles from the pressure. A higher pressure necessary to cause buckling is preferred over buckling occurring at a lower pressure. In the buckle test, a comparison of the can in accordance with a preferred embodiment of the present invention with various prior art cans shows consistent results for the can in accordance with a preferred embodiment of the present invention. For a sample set of prior art cans having a gauge thickness of 0.0104 inches, the buckle was a mean of 104.3 psi, with a standard deviation range of 2.22 psi. For a sample set of cans in accordance with a preferred embodiment of the present invention having a gauge thickness of 0.0110 inches, the buckle was a mean of 104.34 psi, with a standard deviation of 2.36 psi. The results of these tests are shown in Table 1.

Another standard test used is the drop resistance test. Drop resistance is the capability of a container bottom to resist a downward bulge when dropped from a given height. In the drop test, a can is filled with a fluid (typically water), a can lid is seamed to the can, and the can is pressurized to a predetermined pressure. The can is dropped such that the can bottom lands flat on the surface. The can bottom is then checked to determine if it has reversed or bulged outward/downward. The same can is dropped from successively higher heights by one inch increments, until a "first" or partial reversal (downward bulge) of the can bottom is achieved. The height at which the first reversal occurs is noted. The can is then dropped from successively higher heights by one inch increments, until the dome is fully reversed (descends lower than the nose portion 140), so that the can "rocks" when placed on a flat surface. The height at which the "rocking bottom" condition occurs is also noted. A first reversal is important because once the can has reached that stage, the can bottom cannot withstand higher pressures that an undamaged can might withstand. Once a can bottom has had a first reversal, the pressures that the can bottom can withstand are primarily dependent on the thickness of the can bottom, rather than being related to the design of the can bottom.

However, in situations where there are external factors, such as high temperature or high pressure for example, that may influence the behavior of the can once it is filled with a beverage, it has been discovered that cans could meet the specifications of these standard tests, and yet still have an unacceptably high number of failures of the can bottoms in a consumer environment. Further, it was discovered that simply increasing the acceptance criteria for these standard tests did not result in a more accurate prediction of can performance in the actual consumer environment.

Therefore, it was necessary to develop additional tests to more accurately predict performance of the cans in actual use, especially in situations where external factors have a greater impact on can function. To that end, a number of different potential testing methods were tried, and the tests described below were found to predict the behavior of cans in production and consumer environments more accurately than the current tests. These additional tests developed are described in more detail below. It should be noted that the actual pressures in cans and actual drop heights for the testing described will depend on the design of the specific can bottom, and atmospheric conditions, and may vary for other cans and other environments.

The specific pressures, drop heights, and drop angles disclosed in the preferred embodiment below are the ones that were used for testing the specific can bottom in accordance with a preferred embodiment of the present invention to achieve the noted test results, and were those found to be the most accurate predictor of product performance in a consumer environment. However, other drop heights, drop angles and pressures can be used with other can bottoms, and different drop heights, angles, and pressures could be used with the can bottom in accordance with a preferred embodiment of the present invention, depending on various related factors. Additionally, while a conventional "12-pack" package was used for the tests described below to achieve the results disclosed in Table 1, other commercial consumer packaging, with a different number of cans and different packaging shapes and materials, can also be used, such as a 24-pack box, a 6-pack ring carrier, or any of the other numerous varieties of consumer packaging used.

The first additional test is a "consumer package drop test" which is a variation of the standard drop test described above, in which cans were filled and pressurized to about 80-85 psi, then inserted into a standard consumer package (a conventional "12-pack" in this case) and dropped as a unit from a height to a flat surface (in this case, a height of 8 inches above the flat surface), such that the can bottoms landed flat on the surface. The cans are then checked to determine how many cans had suffered a first reversal.

Figure 3:
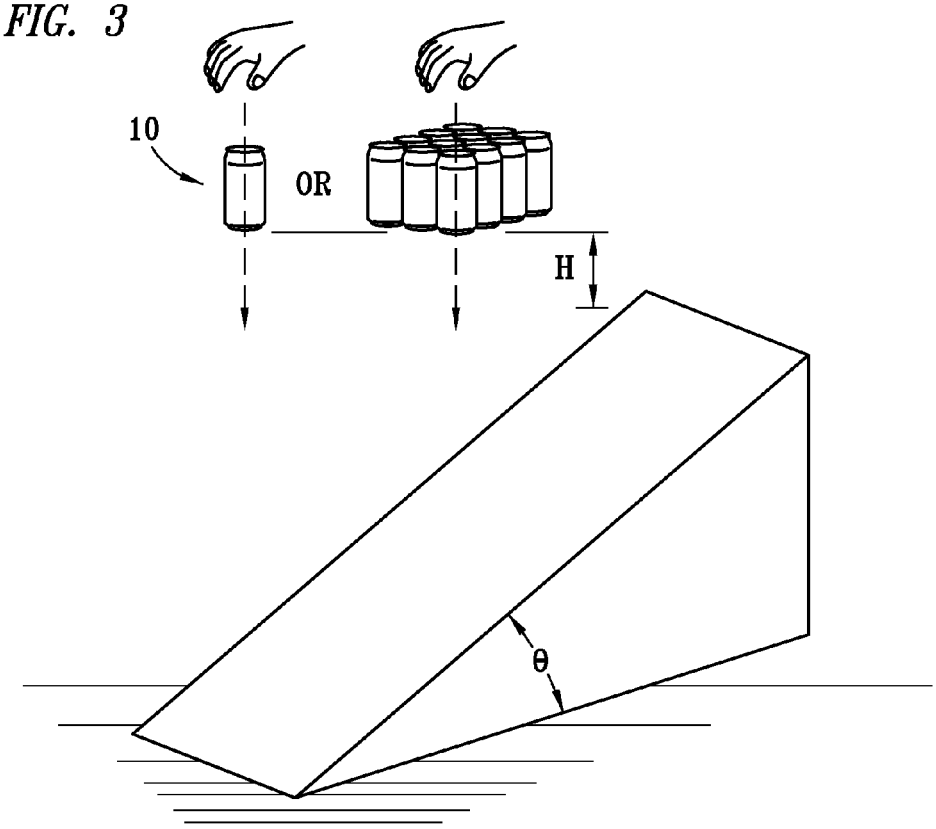
FIG. 3 is a depiction of an angled consumer packaged container drop test.

A second additional test is an "angled drop test" which is also a variation of the standard drop test. In this test, as shown in FIG. 3, a can is filled and pressurized to approximately 60 psi and then dropped, in from a height H (in this case 3 inches), onto a wedge/plate that had an angle θ of approximately 15 degrees from horizontal. It should be noted that these tests were performed at various pressures, heights H and angles θ, and it was found that this combination of test conditions offered the most accurate predictor of performance of these types of cans in actual consumer environments, and so are the preferred test conditions. The can is dropped from greater heights, in increments of 1 inch, until the can bottom suffers a first reversal, the drop height of which is noted. The can is then dropped from successively higher heights by one inch increments, until the dome has fully reversed such that it is lower than the nose portion so that the can "rocks" when placed on a flat surface. The height at which the "rocking bottom" condition occurs is also noted.

Yet a third additional test is the "angled consumer package drop test," one arrangement of which is shown in FIG. 3. In this test, cans were filled and pressurized to 80-85 psi, and then inserted into a standard consumer package (a conventional "12-pack" in this case) and dropped as a unit from a height H at an angle θ onto a flat surface, or, as shown in FIG. 3, dropped as a unit from a height H onto a wedge/plate that has an angle θ. In this embodiment, the angle θ is approximately 15 degrees from horizontal, and at a height of 8 inches above the surface. The cans are then checked to determine how many can bottom domes suffered a first reversal, or fully reversed to a rocking bottom condition. Again, it should be noted that these tests were performed at various pressures, heights and angles, and it was found that this combination of test conditions offered the most accurate predictor of performance of the cans in actual consumer environments, and so are the preferred test conditions.

In the single can and consumer package angled drop tests and consumer package flat drop test, the improvement in test results in accordance with a preferred embodiment of the present invention, versus previous industry cans, provides an indication of the unexpected improvement in drop resistance and dome reversal pressure that was achieved. A comparison of a prior art can and the can in accordance with a preferred embodiment of the present invention showed improved results for the can in accordance with a preferred embodiment of the present invention. These unexpected test improvements over prior art cans are indicators of the improved performance in actual use of the can in accordance with a preferred embodiment of the present invention.

For a sample set of prior art single cans pressurized to 60 psi internal pressure, the height H from which the can was dropped, in inches, when the first reversal was seen was a mean of 8.8 inches, with a standard deviation of 1.0 inches for the "flat drop test," and a mean of 4.2 inches, with a standard deviation of 0.4 inches for the "angled drop test." For a sample set of single cans manufactured in accordance with a preferred embodiment of the present invention pressurized to 60 psi internal pressure, the height H when the first reversal was seen was a mean of 9.3 inches, with a standard deviation of 0.7 inches for the "flat drop test," and a mean of 7.0 inches, with a standard deviation of 0.2 inches for the "angled drop test."

For a prior art sample set of single cans pressurized to 60 psi internal pressure, the height H from which the can was dropped, in inches, when a "rocking bottom" condition was seen (i.e. the dome reversed below the nose portion) was a mean of 9.1 inches, with a standard deviation of 1.1 inches for the "flat drop test," and a mean of 4.7 inches, with a standard deviation of 0.7 inches for the "angled drop test." For a sample set of single cans manufactured in accordance with a preferred embodiment of the present invention pressurized to 60 psi internal pressure, the height H when the rocking bottom condition was seen was a mean of 10.5 inches, with a standard deviation of 0.8 inches for the "flat drop test," and a mean of 8.5 inches, with a standard deviation of 0.6 inches for the "angled drop test."

In the drop tests described above, the consistency in test results in accordance with a preferred embodiment of the present invention, versus previous industry cans, provides an indication of the unexpected improvement in drop resistance that was achieved.

For the consumer package "12-pack" drop test performed from a height H of 8" at a pressure of approximately 80 psi, as described above, for a sample of prior art cans, the number of cans showing a first reversal was a mean of 6.3 cans, with a standard deviation of 1.2 for the "consumer package flat drop test," and a mean of 8.5 cans, with a standard deviation of 2.1 for the "angled consumer package drop test." For a can manufactured in accordance with a preferred embodiment of the present invention, the number of cans with a first reversal in a 12-pack was a mean of 2.3 cans with a standard deviation of 1.1 for the "consumer package flat drop test" and a mean of 2.9 cans with a standard deviation of 1.6 for the "angled consumer package drop test."

TABLE 1

Summary of Test Results

| Test Name | Test Measurement | Prior Art Can Results | MC11 Can Results |
|---|---|---|---|
| Buckle Test | Mean | 104.3 psi | 104.34 psi |
| | Standard Deviation | 2.22 psi | 2.36 psi |
| Flat Drop Resistance Test, Single Can pressurized to 60 psi - First Reversal Height | Mean | 8.8 in. | 9.3 in. |
| | Standard Deviation | 1.0 in. | 0.7 in. |
| Angled Drop Resistance Test, Single Can pressurized to 60 psi - First Reversal Height | Mean | 4.2 in. | 7.0 in. |
| | Standard Deviation | 0.4 in. | 0.2 in. |
| Flat Drop Resistance Test, Single Can pressurized to 60 psi - Rocking Bottom | Mean | 9.1 in. | 10.5 in. |
| | Standard Deviation | 1.1 in. | 0.8 in. |
| Angled Drop Resistance Test, Single Can pressurized to 60 psi - Rocking Bottom | Mean | 4.7 in. | 8.5 in. |
| | Standard Deviation | 0.7 in. | 0.6 in. |
| Consumer (12-pack) Flat Drop Test at 8 in., cans pressurized to 80 psi - number of cans showing first reversal | Mean | 6.3 cans | 2.3 |
| | Standard Deviation | 1.2 | 1.1 |
| Consumer (12-pack) Angled Drop Test at 8 in., cans pressurized to 80 psi - number of cans showing first reversal | Mean | 8.5 cans | 2.9 |
| | Standard Deviation | 2.1 | 1.6 |

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

The invention claimed is:

1. A bottom for a container having a central axis, comprising:

a domed central panel that intersects the central axis;

a substantially cylindrical inner leg portion extending generally downwardly from the central panel and inwardly from the central axis;

a generally semi-circular nose portion extending from adjacent to the inner leg portion, the nose portion forming a ring tangential to a container stand plane;

an outer leg portion extending generally upwardly from outside of the nose portion and outwardly from the central axis; and an inclined peripheral portion extending generally upwardly from the outside of the outer leg portion and generally outwardly from the central axis.

2. The container of claim 1 wherein the domed central panel stands from about 0.435 to about 0.460 inches above the container stand plane.

3. The container of claim 1 wherein the inner leg portion extends inwardly from the central axis at an angle of less than about 4°.

4. The container of claim 1 wherein the outer leg portion extends outwardly from the central axis at an angle of about 27° to about 32°.

5. The container of claim 1 wherein the inclined peripheral portion extends upwardly from the stand plane at an angle of about 27° to about 32 °.

6. A drawn metal bottom for a container having a central axis, a container wall, and a stand plane that is generally perpendicular to the central axis, comprising:

a generally convex first transitional member extending from the container wall generally toward the central axis;

a generally frustoconical peripheral member extending from the first transitional member in the direction of the central axis, the peripheral member being oriented at an angle from about 58° to about 63° relative to the central axis;

a second transitional member extending from the peripheral member, the second transitional member being generally concave;

a generally frustoconical outer leg member extending from the second transitional member;

a nose member extending from the outer leg member, the nose member being generally convex and having a generally semicircular cross-section;

a generally frustoconical inner leg member extending upwardly and outwardly from the nose member;

a third transitional member extending from the inner leg member, the third transitional member being generally concave; and a domed center panel extending from the third transitional member and that intersects the central axis, the apex of the central panel being at a height between about 0.435 inches to about 0.460 inches above the stand plane.

7. The container of claim 6 wherein the outer leg member is at an angle from about 27° to about 32° relative to the central axis.

8. The container of claim 6 wherein the inner leg member is at an angle of less than about 4° relative to the central axis.

9. The container of claim 6 wherein a line drawn between the bottom of the nose member and the intersection of the apex of the first transitional member forms an angle from the stand plane of approximately 38° to about 43°.

* * * * *